US009568868B2

(12) United States Patent
Namekata et al.

(10) Patent No.: US 9,568,868 B2
(45) Date of Patent: Feb. 14, 2017

(54) IMAGE FORMING APPARATUS

(71) Applicants: Shinichi Namekata, Kanagawa (JP); Takeshi Uchitani, Kanagawa (JP); Takamasa Hase, Shizuoka (JP); Shuutaroh Yuasa, Kanagawa (JP); Kazuya Saito, Kanagawa (JP); Ryota Yamashina, Kanagawa (JP); Ippei Fujimoto, Kanagawa (JP); Hiroshi Seo, Kanagawa (JP); Takumi Waida, Tokyo (JP)

(72) Inventors: Shinichi Namekata, Kanagawa (JP); Takeshi Uchitani, Kanagawa (JP); Takamasa Hase, Shizuoka (JP); Shuutaroh Yuasa, Kanagawa (JP); Kazuya Saito, Kanagawa (JP); Ryota Yamashina, Kanagawa (JP); Ippei Fujimoto, Kanagawa (JP); Hiroshi Seo, Kanagawa (JP); Takumi Waida, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 125 days.

(21) Appl. No.: 13/759,443

(22) Filed: Feb. 5, 2013

(65) Prior Publication Data

US 2013/0209120 A1 Aug. 15, 2013

(30) Foreign Application Priority Data

Feb. 9, 2012 (JP) ..... 2012-026148

(51) Int. Cl.
*G03G 15/20* (2006.01)

(52) U.S. Cl.
CPC .. *G03G 15/2042* (2013.01); *G03G 2215/2035* (2013.01)

(58) Field of Classification Search
CPC ..... G03G 15/2078; G03G 15/2082; G03G 15/2039; G03G 15/2042
(Continued)

(56) References Cited

U.S. PATENT DOCUMENTS 6,151,462 A * 11/2000 Fukuzawa et al. ..... 399/67
2004/0184848 A1 9/2004 Oonishi
(Continued)

FOREIGN PATENT DOCUMENTS

JP 2861280 12/1998
JP 11174896 A * 7/1999
(Continued)

OTHER PUBLICATIONS

Okegawa et al. (JP 2007-193165 A), Aug. 2007, JPO Computer Translation.*
(Continued)

*Primary Examiner* — Erika J Villaluna
(74) *Attorney, Agent, or Firm* — Harness, Dickey & Pierce, P.L.C.

(57) ABSTRACT

Heat-equalizing rotation of a fixing member and a pressing member for equalizing the distribution of the temperature of a surface of the fixing member in a width direction is performed after a recording medium having a size less than or equal to a predetermined size in the width direction passes a nip portion and before a recording medium having a size greater than the predetermined size in the width direction passes the nip portion. Further, a termination condition of the heat-equalizing rotation is selected from among a plurality of different kinds of termination conditions, based on image formation related information related to next image formation performed after the heat-equalizing rotation.

10 Claims, 7 Drawing Sheets

(58) Field of Classification Search
USPC ..... 399/67, 69, 329; 3/67, 69, 329
See application file for complete search history.

(56) References Cited

U.S. PATENT DOCUMENTS

| | | | |
|---|---|---|---|
| 2007/0059012 | A1 | 3/2007 | Tomine et al. |
| 2007/0212089 | A1 | 9/2007 | Seo et al. |
| 2007/0242988 | A1 | 10/2007 | Seo et al. |
| 2007/0280754 | A1 | 12/2007 | Ogawa et al. |
| 2007/0292175 | A1 | 12/2007 | Shinshi |
| 2008/0025772 | A1 | 1/2008 | Seo et al. |
| 2008/0025773 | A1 | 1/2008 | Ito et al. |
| 2008/0124147 | A1 | 5/2008 | Uehara et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2009/0060550 | A1 | 3/2009 | Seo |
| 2009/0148205 | A1 | 6/2009 | Seo et al. |
| 2009/0202269 | A1 | 8/2009 | Tomine et al. |
| 2009/0245897 | A1 | 10/2009 | Seo et al. |
| 2009/0297197 | A1* | 12/2009 | Hase ..... G03G 15/2042 399/69 |
| 2010/0061753 | A1 | 3/2010 | Hase |
| 2010/0092220 | A1 | 4/2010 | Hasegawa et al. |
| 2010/0092221 | A1 | 4/2010 | Shinshi et al. |
| 2010/0232822 | A1 | 9/2010 | Takenaka et al. |
| 2010/0290822 | A1 | 11/2010 | Hasegawa et al. |
| 2010/0303521 | A1 | 12/2010 | Ogawa et al. |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052245 | A1 | 3/2011 | Shinshi et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0170917 | A1 | 7/2011 | Yoshikawa et al. |
| 2011/0176821 | A1 | 7/2011 | Hase |
| 2011/0182634 | A1 | 7/2011 | Ishigaya et al. |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206402 | A1 | 8/2011 | Yamashina |
| 2011/0206427 | A1 | 8/2011 | Iwaya et al. |
| 2011/0211876 | A1 | 9/2011 | Iwaya et al. |
| 2011/0217056 | A1 | 9/2011 | Yoshinaga et al. |
| 2011/0217057 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222926 | A1 | 9/2011 | Ueno et al. |
| 2011/0222927 | A1 | 9/2011 | Yamashina |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229161 | A1 | 9/2011 | Ueno et al. |
| 2011/0229162 | A1 | 9/2011 | Ogawa et al. |
| 2011/0229178 | A1 | 9/2011 | Ogawa et al. |
| 2011/0229181 | A1 | 9/2011 | Iwaya et al. |
| 2011/0229200 | A1 | 9/2011 | Yamaguchi et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0274453 | A1 | 11/2011 | Shimokawa et al. |
| 2011/0293309 | A1 | 12/2011 | Hase |
| 2011/0311284 | A1 | 12/2011 | Seo et al. |
| 2012/0045226 | A1 | 2/2012 | Hase et al. |
| 2012/0051766 | A1 | 3/2012 | Ueno et al. |
| 2012/0051774 | A1 | 3/2012 | Ikebuchi et al. |
| 2012/0093531 | A1 | 4/2012 | Yuasa et al. |
| 2012/0093532 | A1 | 4/2012 | Ishigaya et al. |
| 2012/0093534 | A1 | 4/2012 | Waida et al. |
| 2012/0093551 | A1 | 4/2012 | Ogawa et al. |
| 2012/0107005 | A1 | 5/2012 | Hase et al. |
| 2012/0114345 | A1 | 5/2012 | Fujimoto et al. |
| 2012/0114354 | A1 | 5/2012 | Saito et al. |
| 2012/0121303 | A1 | 5/2012 | Takagi et al. |
| 2012/0121304 | A1 | 5/2012 | Tokuda et al. |
| 2012/0121305 | A1 | 5/2012 | Yoshikawa et al. |
| 2012/0148303 | A1 | 6/2012 | Yamaguchi et al. |
| 2012/0155935 | A1 | 6/2012 | Yoshikawa et al. |
| 2012/0155936 | A1 | 6/2012 | Yamaguchi et al. |
| 2012/0177388 | A1 | 7/2012 | Imada et al. |
| 2012/0177393 | A1 | 7/2012 | Ikebuchi et al. |
| 2012/0177420 | A1 | 7/2012 | Shimokawa et al. |
| 2012/0177423 | A1 | 7/2012 | Imada et al. |
| 2012/0177424 | A1 | 7/2012 | Saito et al. |
| 2012/0207502 | A1 | 8/2012 | Seo et al. |
| 2012/0207523 | A1 | 8/2012 | Ueno et al. |
| 2012/0219312 | A1 | 8/2012 | Yuasa et al. |
| 2012/0224878 | A1 | 9/2012 | Ikebuchi et al. |
| 2012/0237273 | A1 | 9/2012 | Yoshinaga et al. |
| 2012/0301161 | A1 | 11/2012 | Fujimoto |

FOREIGN PATENT DOCUMENTS

| | | |
|---|---|---|
| JP | 2002-182521 | 6/2002 |
| JP | 2004-094146 | 3/2004 |
| JP | 2004-286922 | 10/2004 |
| JP | 2007193165 A * | 8/2007 |
| JP | 2007-233011 | 9/2007 |
| JP | 2007-334205 | 12/2007 |
| JP | 2008-129517 | 6/2008 |
| JP | 2010-026256 | 2/2010 |
| JP | 2010-032625 | 2/2010 |
| JP | 2010-078839 | 4/2010 |
| JP | 2010-096782 | 4/2010 |
| JP | 2010-217257 | 9/2010 |
| JP | 4732088 | 4/2011 |
| JP | 4742165 | 5/2011 |
| JP | 2011-180220 | 9/2011 |

OTHER PUBLICATIONS

U.S. Appl. No. 13/557,841, filed Jul. 25, 2012, Toshihiko Shimokawa, et al.

* cited by examiner

IMAGE FORMING APPARATUS

CROSS-REFERENCE TO RELATED APPLICATIONS

The present application claims priority to and incorporates by reference the entire contents of Japanese Patent Application No. 2012-026148 filed in Japan on Feb. 9, 2012.

BACKGROUND OF THE INVENTION

1. Field of the Invention

The present invention relates to an image forming apparatus including a fixing device.

2. Description of the Related Art

As a fixing device used in an image forming apparatus such as a copier, a printer, a facsimile, or an MFP including any of these, a device including a belt-shaped or film-shaped fixing member having an endlessly moving surface and having lower heat capacity, and a heat source for heating the fixing member has been known (for example, see Japanese Patent Application Laid-open No. 2007-334205, Japanese Patent Application Laid-open No. 2007-233011, Japanese Patent Application Laid-open No. 2010-032625, and Japanese Patent Application Laid-open No. 2010-217257). The provision of the fixing member with lower heat capacity can drastically reduce the energy required for heating the fixing member and shorten the warm-up time or first printing time. Here, the warm-up time refers to the time required for increasing the temperature of the fixing member when powered on, for example, from normal temperature to a predetermined printable temperature (reload temperature). The first printing time refers to the time after the reception of a printing request through printing preparation and printing operation until the completion of discharge of paper.

In the conventional fixing device described above, for surely heating a recording medium such as paper to which an image is transferred, a wider range of the fixing member is heated than a range of the fixing member where the printing medium passing a nip portion is in contact in a width direction orthogonal to the surface moving direction. Then, the temperature rise in a part of the range where the surface of the fixing member is heated, that is not in contact with the recording medium, i.e., a portion that corresponds to the outside of both ends of the recording medium in a width direction thereof becomes larger than that in a portion that is in contact with the recording medium; thus, a high-temperature portion having high temperature is formed locally on the surface of the fixing member. The high-temperature portion on the surface of the fixing member is easily formed particularly in the fixing device in which the fixing member with an endless belt form is directly heated as described in Japanese Patent Application Laid-open No. 2007-233011. The formation of the high-temperature portion on the surface of the fixing member might causes the fixing failure such as a hot-offset image or gloss unevenness when the passage of a recording medium with small width is followed by the passage of a recording medium with large width through a nip portion.

Meanwhile, in the image forming apparatus including the fixing device, there has been a request for shortening the image forming time required for forming an image on the recording medium.

Therefore, there is a need for an image forming apparatus that is capable of preventing the occurrence of fixing failure due to the inhomogeneous distribution of temperature of the fixing member in a width direction of the recording medium, which is orthogonal to a recording medium conveying direction, and is capable of shortening the image forming time required for forming the images on these recording media in the case where an image is formed on a recording medium with a size in the width direction, at a nip portion of the fixing device, less than or equal to a predetermined size, and then, an image is formed on a recording medium with the size in the width direction larger than the predetermined size.

SUMMARY OF THE INVENTION

According to an embodiment, there is provided an image forming apparatus including a fixing device. The fixing device includes a rotatable fixing member having an endlessly moving surface; a heat source that heats the fixing member; a rotatable pressing member that is pressed and comes in pressure-contact with the fixing member so as to form a nip portion therebetween; a rotary drive unit that rotationally drives the fixing member or the pressing member; and a control unit configured to control the rotary drive unit to perform heat-equalizing rotation of the fixing member and the pressing member for equalizing distribution of temperature of the surface of the fixing member in a width direction orthogonal to a recording medium conveying direction at the nip portion, after a recording medium having a size less than or equal to a predetermined size in the width direction passes the nip portion and before a recording medium having a size greater than the predetermined size in the width direction passes the nip portion. The control unit is configured to select a termination condition of the heat-equalizing rotation from among a plurality of different kinds of termination conditions based on image formation related information related to next image formation performed after the heat-equalizing rotation.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a schematic configuration explanatory view illustrating installation positions of a thermopile and the like;

DETAILED DESCRIPTION OF THE PREFERRED EMBODIMENT

Figure 1:
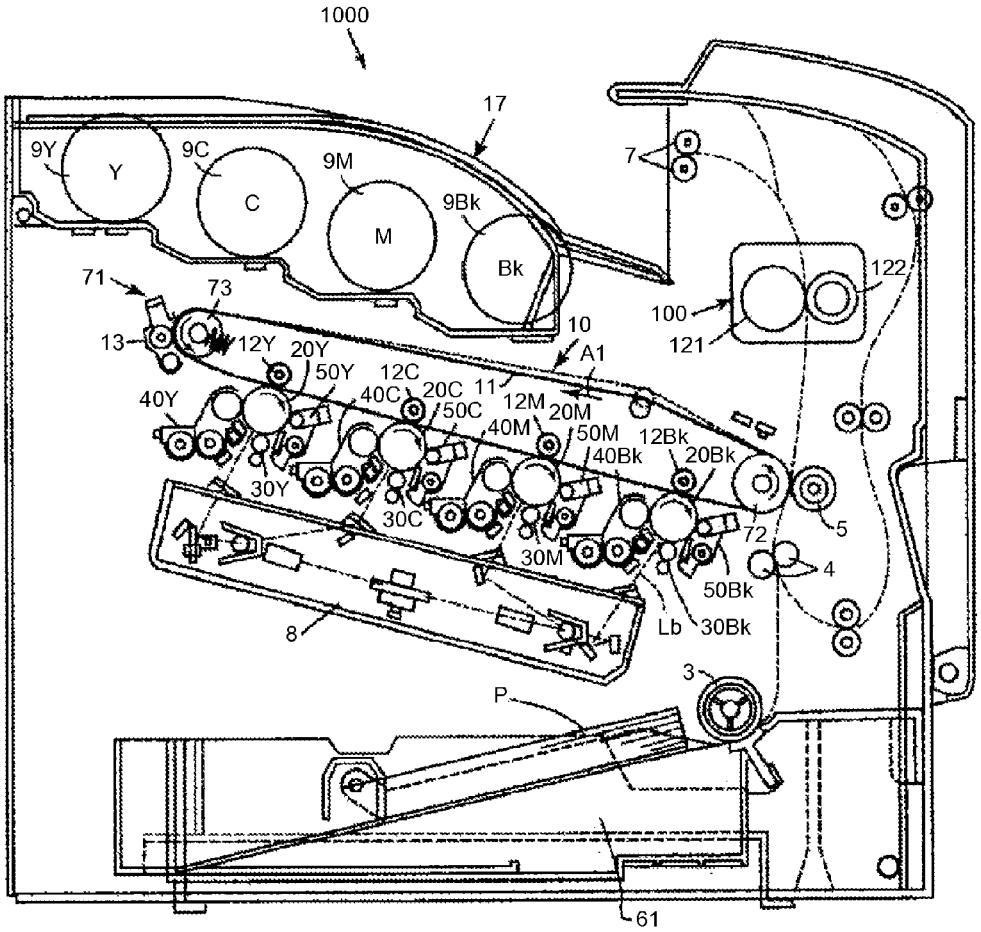
FIG. 1 is a schematic configuration diagram illustrating one configuration example of the entire image forming apparatus according to an embodiment of the present invention.

An embodiment of the present invention is described below with reference to drawings. Note that in the drawings used for describing the embodiment of the present invention, the members or components in configurations having the same function or the same shape are denoted with the same reference symbol as long as discrimination is possible, and the description is not repeated.

First, the entire configuration of an image forming apparatus according to this embodiment of the present invention is described.

FIG. 1 is a schematic configuration diagram illustrating a configuration example of the entire image forming apparatus according to one embodiment of the present invention. The image forming apparatus illustrated in FIG. 1 is a tandem type color laser printer, and is provided with an image station including a plurality of image forming units (four image forming units in the illustrated example) forming color images in the center of the device body. The image forming units are arranged in a direction where an intermediate transfer belt (hereinafter called "transfer belt") as an intermediate transfer body with an endless belt form is extended, and have similar configurations to each other except that they contain different colors of developer of yellow (Y), magenta (M), cyan (C), and black (Bk) corresponding to color separation components of a color image.

In FIG. 1, an image forming apparatus 1000 has photosensitive drums 20Y, 20C, 20M, and 20Bk arranged as a plurality of image carriers respectively corresponding to the colors separated into yellow, cyan, magenta, and black. Toner images as visual images of the colors formed on the photosensitive drums 20Y, 20C, 20M, and 20Bk are subjected to a primary transfer process with respect to a transfer belt 11 movable in a direction of an arrow A1 while the toner images face the photosensitive drums 20Y, 20C, 20M, and 20Bk, and thus the toner images of the respective colors are overlapped on each other and transferred to the transfer belt 11. After that, the toner images overlapped on and transferred to the transfer belt 11 are collectively transferred to paper S as a recording medium by performing a secondary transfer process to the paper S.

Each of the photosensitive drums 20Y, 20C, 20M, and 20Bk is surrounded by various devices for performing image formation processing in accordance with the rotation of the photosensitive drum. Here, description is made of the photosensitive drum 20Bk performing black image formation. The photosensitive drum 20Bk is surrounded by a charging device 30Bk, a developing unit 40Bk, a primary transfer roller 12Bk as a primary transfer unit, and a cleaning device 50Bk, which perform the image formation processing along the rotation direction of the photosensitive drum 20Bk. For writing an electrostatic latent image on the charged photosensitive drum 20Bk, an optical writing device 8 as an exposing unit for light-exposing a surface of the photosensitive drum 20Bk is used.

The optical writing device 8 includes a semiconductor laser as a light source, a coupling lens, an fθ lens, a toroidal lens, a reflection mirror, a rotatable polygonal mirror (polygon mirror) as a light deflector, and the like. The optical writing device 8 irradiates a surface of each of the photosensitive drums 20Y, 20C, 20M, and 20Bk with writing light (laser light) Lb on the basis of image data, so that an electrostatic latent image is formed on each of the photosensitive drums 20Y, 20C, 20M, and 20Bk.

The overlapping and transferring onto the transfer belt 11 are performed so that the visible images (toner images) formed on the photosensitive drums 20Y, 20C, 20M, and 20Bk are overlapped on and transferred to the same position of the transfer belt 11 in a process where the transfer belt 11 moves in the A1 direction in the drawing. More specifically, primary transfer bias is applied to each of the primary transfer rollers 12Y, 12C, 12M, and 12Bk disposed to face the photosensitive drums 20Y, 20C, 20M, and 20Bk with the transfer belt 11 interposed therebetween, respectively. With the primary transfer rollers 12Y, 12C, 12M, and 12Bk to which the primary transfer bias is applied, the visual images (toner images) formed on the photosensitive drums 20Y, 20C, 20M, and 20Bk are overlapped and transferred while the timing is displaced from the upstream side to the downstream side of the A1 direction of the transfer belt 11.

The primary transfer rollers 12Y, 12C, 12M, and 12Bk have the transfer belt 11 interposed between the primary transfer rollers 12Y, 12C, 12M, and 12Bk and the corresponding photosensitive drums 20Y, 20C, 20M, and 20Bk, thereby forming a primary transfer nip. The primary transfer rollers 12Y, 12C, 12M, and 12Bk are connected to a power supply, which is not shown, so that primary transfer bias including a predetermined direct-current voltage (DC) and/or alternating-current voltage (AC) is applied to the primary transfer rollers 12Y, 12C, 12M, and 12Bk.

The photosensitive drums 20Y, 20C, 20M, and 20Bk are arranged in this order from the upstream side of the A1 direction in the drawing. The photosensitive drums 20Y, 20C, 20M, and 20Bk are provided in the image forming units which form the images of yellow, cyan, magenta, and black, respectively.

The image forming apparatus 1000 includes, in addition to the image forming units, a transfer belt unit (transferring device) 10 disposed above the photosensitive drums 20Y, 20C, 20M, and 20Bk, a secondary transfer roller 5 as a secondary transfer unit, a transfer belt cleaning device 13, and the optical writing device 8 disposed below the image forming units.

The transfer belt unit 10 includes, in addition to the transfer belt 11 as the aforementioned endless belt and the primary transfer rollers 12Y, 12C, 12M, and 12Bk, a plurality of belt supporting members such as a driving roller 72 and a driven roller 73 around which the transfer belt 11 is wound. By rotationally driving the driving roller 72, the transfer belt 11 runs around (rotate) in an arrow A1 direction in the drawing. The driving roller 72 also serves as a secondary transfer backup roller facing the secondary transfer roller 5 via the transfer belt 11. The driven roller 73 also serves as a cleaning backup roller facing the transfer belt cleaning device 13 via the transfer belt 11. Since the driven roller 73 also has a function as a tension applying unit relative to the transfer belt 11, the driven roller 73 is provided with a strength increasing unit including a spring or the like. A transferring device 71 is formed so as to include the transfer belt unit 10, the primary transfer rollers 12Y, 12C, 12M, and 12Bk, the secondary transfer roller 5, and the transfer belt cleaning device 13.

The secondary transfer roller 5 is disposed facing the transfer belt 11, and is rotated following the transfer belt 11. The secondary transfer roller 5 has the transfer belt 11 held between the secondary transfer roller 5 and the driving roller 72 which also serves as the secondary transfer backup roller, thereby forming a secondary transfer nip. In a manner similar to the above primary transfer rollers 12Y, 12C, 12M, and 12Bk, the secondary transfer roller 5 is also connected to a power supply, which is not shown, so that secondary transfer bias including a predetermined direct-current (DC) voltage and/or alternating-current (AC) voltage is applied to the secondary transfer roller 5.

The transfer belt cleaning device 13 is disposed facing the driven roller 73 via the transfer belt 11 and cleans the surface of the transfer belt 11. In the illustrated example, the belt cleaning device 13 includes a cleaning brush and a cleaning blade disposed abutted on the transfer belt 11. A waste toner transportation hose, which is not shown, extending from the belt cleaning device 13 is connected to the entrance of a waste toner container, which is not shown.

Moreover, the image forming apparatus 1000 includes a paper cassette (paper feeding device) 61 as a recording medium storage unit in which paper S as a recording medium is stored, a registration roller pair 4 as a recording medium feeding unit, and a paper tip sensor, which is not shown, as a recording medium tip detecting unit. The paper cassette 61 is disposed in a lower part of the body of the image forming apparatus 1000, and includes a feeding roller 3 as a recording medium feeding unit which abuts on a top surface of the uppermost sheet of paper S. When the feeding roller 3 is rotated and driven counterclockwise, the uppermost sheet S is fed toward the registration roller pair 4.

Moreover, the printer body includes a paper conveying path for letting the paper P pass the secondary transfer nip from the paper cassette 61 out of the device. The registration roller pair 4 for conveying the paper P to the secondary transfer unit (secondary transfer nip) is disposed on the upstream side in the paper conveying direction as compared with the secondary transfer roller 5 in this paper conveying path R. The registration roller pair 4 feeds the paper S conveyed from the paper cassette 61 to the secondary transfer unit (secondary transfer nip) between the secondary transfer roller 5 and the transfer belt 11 at a predetermined timing in accordance with the timing at which a toner image is formed by the image station including the image forming units. The paper tip sensor detects the arrival of the tip of the paper S at the registration roller pair 4.

Here, the paper as the recording medium includes, in addition to plain paper, thick paper, postcards, envelopes, thin paper, coated paper (such as coat paper or art paper), tracing paper, OHP sheets, recording sheets, and the like. In addition to the paper cassette 61 such as the paper cassette, a manual bypass paper feeding mechanism that allows the manual supply of paper may be provided.

The image forming apparatus 1000 includes a fixing device 100 as a fixing unit for fixing the toner image on the paper S to which the toner image has been transferred, a discharging roller 7 as a recording medium discharging unit, a discharge tray 17 as a recording medium mount unit, and toner bottles 9Y, 9C, 9M, and 9Bk as toner containers. The discharging roller 7 discharges the fixed paper S out of the body of the image forming apparatus 1000. The discharge tray 17 is disposed in an upper part of the body of the image forming apparatus 1000, and has the paper S discharged out of the image forming apparatus 1000 by the discharging roller 7 mounted thereon.

The toner bottles 9Y, 9C, 9M, and 9Bk are filled with toners of yellow, cyan, magenta, and black, respectively, and are detachably attached to the bottle containers provided below the discharge tray 17 in the upper part of the printer body. A replenishment path, which is not shown, is provided between the toner bottles 9Y, 9C, 9M, and 9Bk and the developing units 40Y, 40C, 40M, and 40Bk, and through this replenishment path, the toner is supplied from the toner bottles 9Y, 9C, 9M, and 9Bk to the corresponding developing units 40Y, 40C, 40M, and 40Bk.

Although detailed illustration is omitted, the transfer belt cleaning device 13 attached to the transferring device 71 includes a cleaning brush and a cleaning blade which are provided to face and abut on the transfer belt 11. With this cleaning brush and cleaning blade, foreign substances such as the remaining toner on the transfer belt 11 are removed and the transfer belt 11 is thus cleaned. The transfer belt cleaning device 13 includes a discharging unit, which is not shown, for transporting and abandoning the remaining toner removed from the transfer belt 11.

Next, the basic operation of the image forming apparatus 1000 with the above configuration is described.

Upon the start of the image forming operation in the image forming apparatus 1000, the photosensitive drums 20Y, 20C, 20M, and 20Bk in the image forming units are rotated and driven clockwise in the drawing by a driving device, which is not shown, and surfaces of the photosensitive drums 20Y, 20C, 20M, and 20Bk are uniformly charged to a predetermined polarity by the charging devices 30Y, 30C, 30M, and 30Bk. The charged surfaces of the photosensitive drums 20Y, 20C, 20M, and 20Bk are irradiated with laser light from the optical writing device 8, thereby forming an electrostatic latent image on each of the surfaces of the photosensitive drums 20Y, 20C, 20M, and 20Bk. On this occasion, the image information provided by the exposure for the photosensitive drums 20Y, 20C, 20M, and 20Bk is image information of a single color obtained by separating a desired full-color image into color information of yellow, magenta, cyan, and black. By supplying the toner to the electrostatic latent images formed on the photosensitive drums 20Y, 20C, 20M, and 20Bk with the developing units 40Y, 40C, 40M, and 40Bk, the electrostatic latent images are made into visual images (visualized) as toner images.

Upon the start of the image forming operation, the driving roller (secondary transfer backup roller) 72 is rotated and driven counterclockwise in FIG. 1, so that the transfer belt 11 runs around in an arrow A1 direction in the drawing. Then, constant-voltage-controlled or constant-current-controlled voltage with a polarity opposite to the polarity of the charging of the toner is applied to each of the primary transfer rollers 12Y, 12C, 12M, and 12Bk. Thus, a predetermined transfer electric field is formed at the primary transfer nip between each of the primary transfer rollers 12Y, 12C, 12M, and 12Bk and each of the photosensitive drums 20Y, 20C, 20M, and 20Bk.

After that, when the toner images on the photosensitive drums 20Y, 20C, 20M, and 20Bk have reached the primary transfer nip along with the rotation of the photosensitive drums 20Y, 20C, 20M, and 20Bk, the toner images on the photosensitive drums 20Y, 20C, 20M, and 20Bk are sequentially overlapped on and transferred to the transfer belt 11 by the transfer electric field formed at the primary transfer nip. In this manner, the full-color toner image is held on the surface of the transfer belt 11. The toner on the photosensitive drums 20Y, 20C, 20M, and 20Bk that cannot be transferred to the transfer belt 11 is removed by the cleaning devices 50Y, 50C, 50M, and 50Bk. After that, the electrification on the surfaces of the photosensitive drums 20Y, 20C, 20M, and 20Bk is eliminated by an electrification eliminator, which is not shown, thereby initializing the surface potential.

In the lower part of the image forming apparatus, the feeding roller 3 starts to rotate and drive, thereby sending the paper P from the paper cassette 61 to the conveying path.

The paper P sent into the conveying path is sent to the secondary transfer nip between the secondary transfer roller 5 and the driving roller (secondary transfer backup roller) 72 in accordance with the timing determined by the registration roller pair 4. On this occasion, a transfer voltage with the polarity opposite to the polarity of the charging of the toner of the toner image on the transfer belt 11 is applied to the secondary transfer roller 5, whereby a predetermined transfer electric field is formed at the secondary transfer nip.

After that, when the toner images on the transfer belt 11 have reached the secondary transfer nip along with the running around of the transfer belt 11, the toner images on the transfer belt 11 are collectively transferred to the paper P by the transfer electric field formed at the secondary transfer nip. The remaining toner on the transfer belt 11, which cannot be transferred to the paper P, is removed by the transfer belt cleaning device 13, and the removed toner is conveyed and collected into a waste toner container, which is not shown.

After that, the paper P is conveyed to the fixing device 100, and the toner image on the paper P is fixed on the paper P by the fixing device 100. Then, the paper P is discharged out of the device by the discharging roller 7, and stored on the discharge tray 17.

The above description has been made of the image formation operation for forming the full-color image on the paper; however, a monochromatic image may be formed using any one of the four image forming units, or two- or three-color image may be formed using two or three of the four image forming units.

Next, a more specific configuration example of the fixing device 100 that can be used for the image forming apparatus 1000 with the above configuration will be described.

Figure 2:
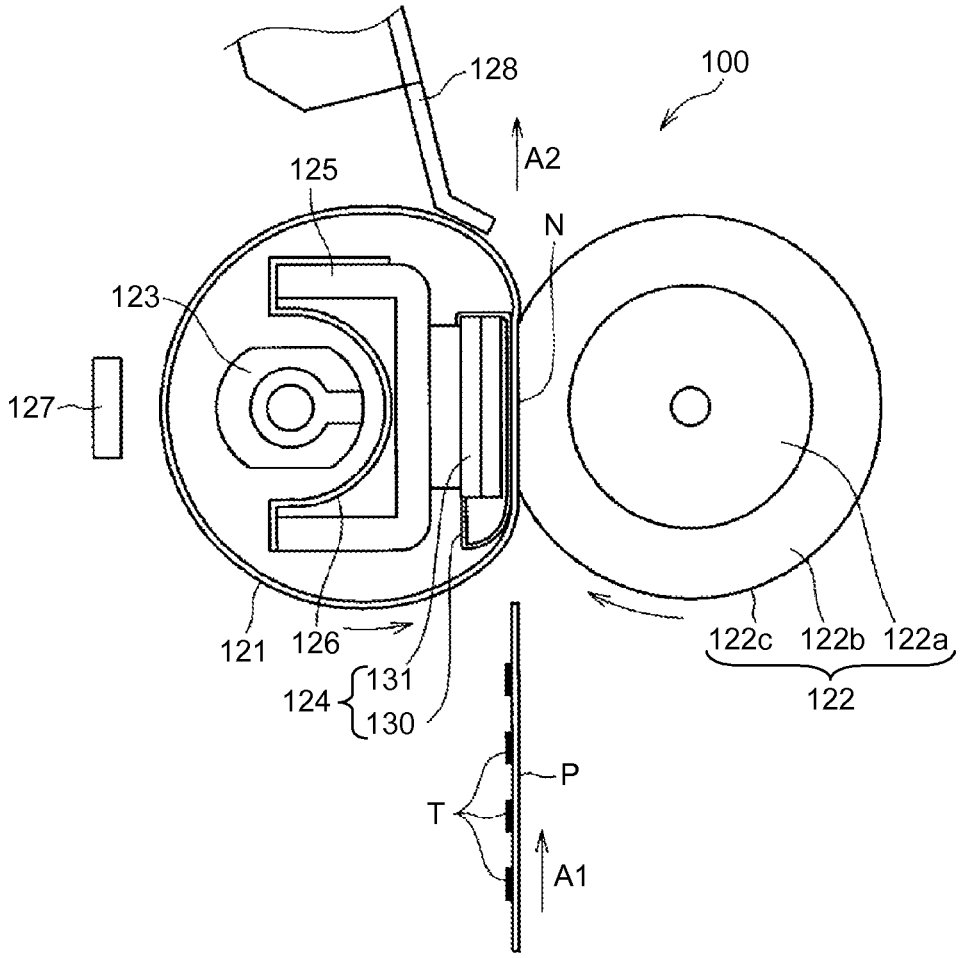
FIG. 2 is a schematic configuration diagram illustrating one configuration example of a fixing device according to this embodiment.

FIG. 2 is a schematic configuration diagram illustrating a configuration example of the fixing device 100 according to this embodiment. In FIG. 2, the fixing device 100 includes: a fixing belt 121 which is a rotatable heating rotator, as a fixing member; a pressing roller 122 which is a counter rotator provided rotatably facing the fixing belt 121 as a pressing member; and a halogen heater 123 as a heat source for heating the fixing belt 121. Moreover, the fixing device 100 includes: a nip forming unit including a nip forming member 124 that forms a nip portion N with the pressing roller 122 that the nip forming member 124 faces via the fixing belt 121 and including a stay 125 as a supporting member supporting the nip forming member 124; and a reflecting member 126 that reflects the light radiated from the halogen heater 123 toward the fixing belt 121. The fixing device 100 includes: a temperature sensor 127 as a temperature detecting unit for detecting the temperature of the fixing belt 121; a separating member 128 as a recording medium separating unit for separating the paper from the fixing belt 121; a pressing unit, which is not shown, for pressing the pressing roller 122 toward the fixing belt 121, and the like.

The fixing belt 121 is directly heated by the radiation heat from the halogen heater 123 from the inner peripheral side thereof. The nip forming member 124 is provided inside the fixing belt 121, i.e., for the inside surrounded by the inner peripheral side of the fixing belt 121, and is disposed so that the nip forming member 124 directly slides on the inner surface of the fixing belt 121 or so that the nip forming member 124 indirectly slides with a slide sheet, which is not shown, interposed therebetween.

In the example of FIG. 2, the nip portion N has a flat shape; however, the shape may be a concave shape or any other shape. In the case where the nip portion has a concave shape, the discharging direction of the tip of the paper S is closer to the pressing roller 122 to improve the separation property, so that the occurrence of jam is suppressed.

The fixing belt 121 includes a thin and flexible endless belt member (including a film). More specifically, the fixing belt 121 includes a base material on the inner peripheral side, which is formed using a metal material such as nickel or SUS or a resin material such as polyimide (PI), and a release layer on the outer peripheral side formed using tetrafluoroethylene-perfluoroalkylvinylether copolymer (PFA) or polytetrafluoroethylene (PTFE). The release layer provides a release property so as to avoid the adhesion of the toner. Between the base material and the release layer may be provided an elastic layer formed using a rubber material such as silicone rubber, expandable silicone rubber, or fluorine rubber. When an unfixed image is pressed and fixed, the presence of the elastic layer such as a silicone rubber layer makes it less probable to cause the microscopic unevenness on the surface of the belt to be transferred to the image with gloss unevenness like an orange peel surface (orange peel surface image) and to remain on the solid part of the image. In order to prevent the occurrence of the gloss unevenness like an orange peel surface (orange peel surface image) effectively, for example, the silicone rubber layer preferably has predetermined thickness or more (for example, 100 [μm] or more). By the deformation of the silicone rubber layer, the microscopic unevenness of the belt surface is absorbed to improve the orange peel surface image.

The pressing roller 122 includes: a core metal 122*a*; an elastic layer 122*b* provided on the outer peripheral surface side of the core metal 122*a* and including expandable silicone rubber, silicone rubber, fluorine rubber, or the like; and a release layer 122*c* provided for a surface of the elastic layer 122*b* and including PFA, PTFE, or the like. The pressing roller 122 is pressed toward the fixing belt 121 by a pressing unit such as a spring, which is not shown, and abuts on the nip forming member 124 via the fixing belt 121. At a portion where the pressing roller 122 and the fixing belt 121 are in pressure-contact with each other, the elastic layer 122*b* of the pressing roller 122 is crushed to form the nip portion N with predetermined width.

The pressing roller 122 is configured to rotate and drive by transmission of a driving force applied via a gear or the like from a drive source such as a motor, which is not shown, provided for the body of the image forming apparatus 1000. The rotation and driving of the pressing roller 122 transmits its driving force to the fixing belt 121 at the nip portion N, thereby driving the fixing belt 121 to rotate together.

The fixing belt 121 is rotated following the pressing roller 122. In the configuration example of FIG. 2, the pressing roller 122 is rotated by the drive source such as a motor, which is not shown, and the drive force is transmitted to the fixing belt 121 at the nip portion N, so that the fixing belt 121 is rotated. The fixing belt 121 is rotated by being interposed at the nip portion N, and runs along a belt holding member 140, which is described later, at the both ends other than the nip portion N.

Although the pressing roller 122 is a solid roller in this embodiment, the pressing roller 122 may be a hollow roller. In the latter case, the inside of the pressing roller 122 may be provided with a heat source such as a halogen heater. In the absence of the elastic layer, the heat capacity is reduced to improve the fixing property; however, there is a risk of gloss unevenness caused in the solid part of the image due to the transfer of the microscopic unevenness on the belt surface to the image when the unfixed toner is crushed for fixture. To prevent this, the elastic layer is desirably provided with a thickness of 100 [μm] or more. By the provision of the elastic layer with a thickness of 100 [μm] or more, the microscopic unevenness can be absorbed due to the elastic deformation of the elastic layer 122*b*; therefore, the occurrence of the gloss unevenness can be avoided.

The elastic layer 122*b* of the pressing roller 122 may be solid rubber. When there is no heat source inside the pressing roller 122, rubber with high heat-insulating property such as sponge rubber may be used as the elastic layer 122*b*. The use of the rubber with high heat-insulating property such as sponge rubber makes it difficult to take the heat off from the fixing belt 121, which is more desirable. The fixing member such as the fixing belt 121 which is the heating rotator and the pressing member such as the pressing roller 122 which is the counter rotator may have the configuration in which, instead of being in pressure contact with each other, they are simply in contact with each other without pressure application.

Both ends of the halogen heater 123 are fixed to a side plate 142 of the fixing device 100 (see FIG. 3). The halogen heater 123 is configured to generate heat while the output thereof is controlled by a power supply unit provided in the body of the image forming apparatus 1000. The output control of the halogen heater 123 by this power supply unit is performed so that the turning-on/off of the halogen heater 123 or the power supply amount is controlled based on the detection result of the surface temperature of the fixing belt 121 by the temperature sensor 127, for example. Through such output control of the halogen heater 123, the temperature (fixing temperature) of the fixing belt 121 can be set at desired temperature. As the heat source for heating the fixing belt 121, an IH heater (inductive heater), a resistance heater, a carbon heater, or the like may be used instead of the halogen heater.

The nip forming member 124 includes a base pad 131, and a slide sheet (low-friction sheet) 130 provided on a surface of the base pad 131. The base pad 131 is provided in a rectangular form continuously in an axial direction of the fixing belt 121 or an axial direction of the pressing roller 122, and determines the shape of the nip portion N by receiving the pressure force from the pressing roller 122.

The base pad 131 of the nip forming member 124 is fixed and supported by the stay 125. This can prevent the nip forming member 124 from being bent by the pressure of the pressing roller 122 and provide the uniform nip width along the axial direction of the pressing roller 122.

The base pad 131 of the nip forming member 124 is formed using a heat-resistance member that can resist a temperature of 200° C. or more. Thus, the thermal deformation of the nip forming member 124 in the toner fixing temperature range is prevented and the stable state of the nip portion N is secured to stabilize the output image quality. For the base pad 131, general heat-resistant resin can be used such as polyether sulfone (PES), polyphenylene sulfide (PPS), liquid crystal polymer (LCP), polyether nitrile (PEN), polyamide imide (PAI), or polyether ether ketone (PEEK).

The slide sheet 130 may be disposed on at least a surface of the base pad 131 that faces the fixing belt 121. Thus, the fixing belt 121 slides relative to the low-friction sheet during the rotation of the fixing belt 121, so that the drive torque in the fixing belt 121 is reduced, thereby reducing the load on the fixing belt 121 by the friction power. Note that the slide sheet may be omitted.

The stay 125 is desirably formed using a metal material with high mechanical strength, such as stainless steel or iron for satisfying the anti-bending function of the nip forming member 124. The base pad 131 is also desirably formed using a material with a certain degree of hardness for securing the strength. As the material for the base pad 131, a resin such as liquid crystal polymer (LCP), metal, ceramic, or the like can be used.

The reflecting member 126 is disposed between the stay 125 and the halogen heater 123. In this embodiment, the reflecting member 126 is fixed to the stay 125. As the material for the reflecting member 126, aluminum, stainless steel, or the like is given. By the provision of the reflecting member 126, the light (radiation heat) radiated from the halogen heater 123 toward the stay 125 is reflected to the fixing belt 121. This can increase the amount of light of the radiation heat delivered to the fixing belt 121, so that the fixing belt 121 can be efficiently heated. Instead of providing the reflecting member 126, a surface of the stay 125 or the like may be subjected to mirror surface processing to provide the similar effect.

Various configuration devises have been made on the fixing device 100 according to this embodiment for further improving energy saving property and the first printing time and the like.

Specifically, the fixing belt 121 can be directly heated at a portion other than the nip portion N by the halogen heater 123 (direct heating type). In this embodiment, nothing is interposed between the halogen heater 123 and the left part of the fixing belt 121 in FIG. 2, so that the radiation heat from the halogen heater 123 is directly given to the fixing belt 121 in that space.

For reducing the heat capacity of the fixing belt 121, the fixing belt 121 is reduced in thickness and diameter. Specifically, the thicknesses of the base material, the elastic layer, and the separation type layer of the fixing belt 121 are set in the range of 20 to 50 [μm], 100 to 300 [μm], and 10 to 50 [μm], respectively, so that the total thickness is set to 1 [mm] or less. The diameter of the fixing belt 121 is set in the range of 20 to 40 [mm]. For further reducing the heat capacity, the thickness of the entire fixing belt 121 is desirably set to 0.2 [mm] or less, and more desirably to 0.16 [mm] or less. The diameter of the fixing belt 121 is desirably set to 30 [mm] or less.

Note that in this embodiment, the diameter of the pressing roller 122 is set in the range of 20 to 40 [mm], and the diameter of the fixing belt 121 and the diameter of the pressing roller 122 are configured to be equal to each other. However, the configuration is not limited to this. For example, the diameter of the fixing belt 121 may be smaller than that of the pressing roller 122. In this case, the curvature of the fixing belt 121 at the nip portion N is smaller than that of the pressing roller 122, so that the paper (recording medium) P discharged from the nip portion N is easily separated from the fixing belt 121.

As a result of reducing the diameter of the fixing belt 121 as mentioned above, the space inside the fixing belt 121 is reduced. However, when the stay 125 is formed to have a concave shape with the both sides folded, and houses the halogen heater 123 inside the concave shape, the stay 125 and the halogen heater 123 can be disposed inside the small space.

Figure 3A:
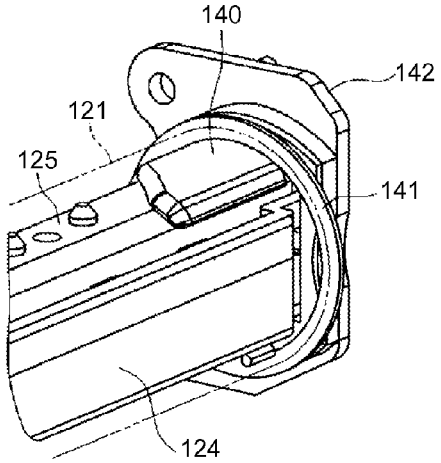
FIGS. 3A, 3B, and 3C are a perspective view, a plan view, and a side view illustrating a configuration of an end of a fixing belt, respectively.
Figure 3B:
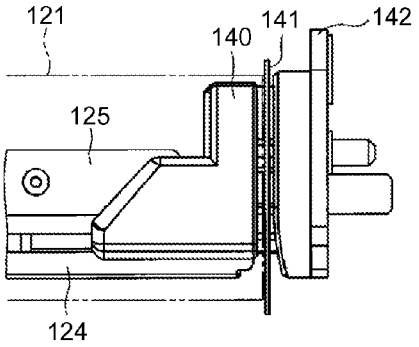
Figure 3C:
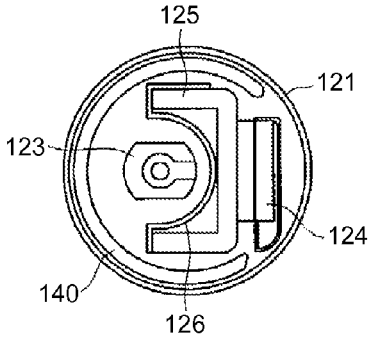

FIG. 3 illustrate the configuration of an end of the fixing belt 121. FIG. 3A is a perspective view, FIG. 3B is a plan view, and FIG. 3C is a side view seen from a rotation axis direction of the fixing belt 121. FIGS. 3A to 3C illustrate only the configuration of one side end; since the other side end also has the similar configuration, the following description is made of just the configuration of one side end based on FIG. 3.

As illustrated in FIG. 3A and FIG. 3B, the belt holding member 140 is inserted at the end of the fixing belt 121 in a direction (axial direction) orthogonal to a direction of surface movement, and this belt holding member 140 maintains the end of the fixing belt 121 rotatable. As illustrated in FIG. 3C, the belt holding member 140 has a flange-like shape, for example, and is formed like a letter of C opening at a position of the nip portion N (position where the nip forming member 124 is disposed). The belt holding member 140 is fixed at the side plate 142. The end of the stay 125 in the longitudinal direction is fixed to and positioned on the side plate 142. The side plate 142 is formed using a metal material such as stainless steel or iron like the stay 125. By forming the side plate 142 with the same material as the stay 125, the attachment accuracy can be obtained easily.

Moreover, as illustrated in FIGS. 3A and 3B, a slip ring 141 as a protective member for protecting the end of the fixing belt 121 is provided between an end face of the fixing belt 121 and a counter surface of the belt holding member 140 that faces the end face of the fixing belt 121. Accordingly, when the deviation in the axial direction occurs in the fixing belt 121, the end of the fixing belt 121 can be prevented from directly abutting on the belt holding member 140 and the frictional wear and damage of the end thereof can be prevented. Since the slip ring 141 is fitted with a margin to the outer periphery of the belt holding member 140, the slip ring 141 can be rotated following the fixing belt 121 when the end of the fixing belt 121 touches the slip ring 141. On this occasion, however, the slip ring 141 is not necessarily rotated together but may stand still. For the material of the slip ring 141, a material with excellent heat resistance, for example, super engineer plastic, such as PEEK, PPS, PAI, or PTFE is preferable.

Although not illustrated, a blocking member for blocking the heat from the halogen heater 123 is provided between the fixing belt 121 and the halogen heater 123 at each end of the fixing belt 121 in the axial direction. This can suppress excessive temperature rise in a paper non-feeding region of the fixing belt during the continuous paper feeding, and prevent thermal deterioration or damage of the fixing belt.

A basic operation example of the fixing device 100 according to this embodiment is described with reference to FIG. 2.

By turning on a power supply switch (main power supply ON) of the image forming apparatus 1000 body, the warm-up operation is started. Specifically, the power is supplied to the halogen heater 123, and the pressing roller 122 starts to rotate and drive clockwise in FIG. 2. Thus, the fixing belt 121 is rotated and driven counterclockwise in FIG. 2 due to the friction power with the pressing roller 122. The temperature of the fixing belt 121 is detected by the temperature sensor 127, and the warm-up operation is performed until the temperature of the fixing belt 121 reaches predetermined temperature. In the warm-up operation at the main power ON time, the fixing belt 121 is heated to predetermined temperature (158° C. to 170° C.) higher than the fixing temperature.

When the fixing belt 121 has reached the predetermined temperature, the power supply to the halogen heater 123 is turned off to drop the temperature of the fixing belt 121 to the fixing temperature. After that, the paper P carrying an unfixed toner image T in the aforementioned image forming process is conveyed in an arrow A1 direction of FIG. 2 while the paper P is guided by a guide plate, which is not shown, and sent into the nip portion N of the fixing belt 121 and the pressing roller 122 in the pressure contact state. On this occasion, the power supplied to the halogen heater 123 is controlled so that the fixing belt 121 is maintained at the fixing temperature on the basis of the detection result of the temperature sensor 127. In a specific example, when the temperature sensor 127 has detected that the temperature of the fixing belt 121 is fixing temperature $+\alpha°$ C., the power supply to the halogen heater 123 is stopped; when the temperature sensor 127 has detected that the temperature of the fixing belt 121 is fixing temperature $-\alpha°$ C., the power supply to the halogen heater 123 is started. The toner image T is fixed on the surface of the paper P by the heat from the fixing belt 121 heated by the halogen heater 123 and the pressure force between the fixing belt 121 and the pressing roller 122.

The paper P with the toner image T fixed thereon is conveyed in an arrow A2 direction of FIG. 2 from the nip portion N. On this occasion, the paper P is separated from the fixing belt 121 by bringing the tip of the paper P in contact with a tip of the separating member 128. After that, the separated paper P is discharged out of the machine by the discharging roller and stored in the discharge tray as described above.

Upon the completion of the image forming operation, the fixing device moves on to the stand-by mode with the temperature of the fixing belt 121 maintained at predetermined temperature (90° C. in this embodiment) lower than the fixing temperature, or a sleep mode (energy-saving mode) with the power supply to the halogen heater 123 or the rotation and driving of the pressing roller 122 stopped. Whether the mode is set to the stand-by mode or the sleep mode after the image forming operation can be set from an operation unit 151 (see FIG. 5) or the like. When the stand-by mode is set, the temperature of the fixing belt 121 can be increased rapidly to the fixing temperature in the warm-up operation at the next image forming operation, so that the stand-by time up to the start of the image forming operation can be shortened. Meanwhile, in the sleep mode, the power consumption during the standby can be suppressed to save the energy further. For starting up from the stand-by mode, the warm-up operation ends as soon as the temperature of the fixing belt 121 reaches the fixing temperature; for starting up from the sleep mode, the warm-up operation ends as soon as the temperature of the fixing belt 121 reaches predetermined temperature higher than the fixing temperature.

Figure 4:
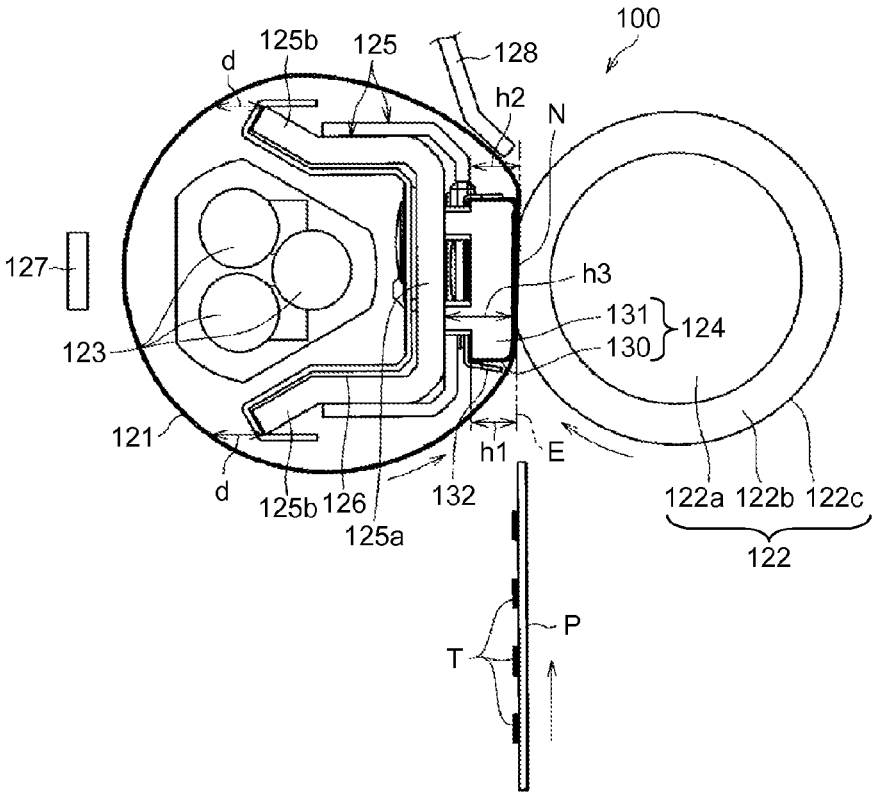
FIG. 4 is a schematic configuration diagram illustrating another configuration example of the fixing device according to this embodiment.

FIG. 4 is a schematic configuration diagram illustrating another configuration example of the fixing device 100 according to this embodiment. The component in the configuration example of the fixing device of FIG. 4 which is similar to that of the configuration described with reference to FIG. 2 and FIG. 3 is denoted with the same reference symbol and description of that component is not repeated.

The fixing device 100 illustrated in FIG. 4 includes three halogen heaters 123 as a heat source. In this case, by differentiating the heat generation region for each halogen heater 123, the fixing belt 121 can be heated in the range corresponding to various paper widths. In this case, also, a sheet metal 132 is provided surrounding the nip forming member 124; the nip forming member 124 is supported by the stay 125 through this sheet metal 132.

In order to dispose the stay 125 as large as possible in the small space, the nip forming member 124 is formed to be small, on the contrary, in the fixing device 100 illustrated in FIG. 4. Specifically, the width of the base pad 131 in the paper conveying direction is made smaller than the width of the stay 125 in the paper conveying direction. Moreover, in FIG. 4, $h1 \leq h3$ and $h2 \leq h3$ are satisfied in the configuration where: h1 and h2 represent the heights of an upstream side end part and a downstream side end part of the nip forming member 124 in the paper conveying direction from the nip portion N or its virtual extension line E, respectively; and h3 represents the maximum height of a part of the nip forming member 124 other than the upstream side end part and the downstream side end part from the nip portion N or its virtual extension line E. By the configuration as above, the upstream side end part and the downstream side end part of the nip forming member 124 do not exist between the fixing belt 121 and each folded part of the stay 125 on the upstream side and the downstream side in the paper conveying direction; therefore, each folded part of the stay 125 can be disposed close to the inner peripheral surface of the fixing belt 121. This allows the stay 125 to be disposed as large as possible in the limited space in the fixing belt 121, and secures the strength of the stay 125. As a result, the bending of the nip forming member 124 by the pressing roller 122 can be prevented and the fixing property can be improved.

For further securing the strength of the stay 125, in this embodiment, the stay 125 includes a base part 125*a* extending in the paper conveying direction (upward and downward in FIG. 4) in contact with the nip forming member 124, and a rising part 125*b* extending from each end of the base part 125*a* on the upstream side and the downstream side in the paper conveying direction toward the abutting direction of the pressing roller 122 (to the left side in FIG. 4). That is to say, by the provision of the rising part 125*b* for the stay 125, the stay 125 comes to have a horizontally long cross section extending in the pressing direction of the pressing roller 122, so that the section modulus is increased to improve the mechanical strength of the stay 125.

The strength of the stay 125 is improved when the rising part 125*b* of the stay 125 is formed longer in the abutting direction of the pressing roller 122. A tip of the rising part 125*b* desirably faces as close to the inner peripheral surface of the fixing belt 121 as possible. However, the rotation involves a certain degree of vibration (disorder of behavior) of the fixing belt 121; therefore, when the tip of the rising part 125*b* is too close to the inner peripheral surface of the fixing belt 121, there is a risk that the fixing belt 121 touches the tip of the rising part 125*b*. In particular, in the configuration including the thin fixing belt 121 as in this embodiment, the vibration of the fixing belt 121 is intense; in this case, the position of the tip of the rising part 125*b* needs to be carefully set.

Specifically, in this embodiment, the distance d between the tip of the rising part 125*b* of the stay 125 and the inner peripheral surface of the fixing belt 121 in the abutting direction of the pressing roller 122 is preferably at least 2.0 [mm], desirably 3.0 [mm] or more. Meanwhile, when the fixing belt 121 is thick to some extent to cause almost no vibration, the distance d can be set to 0.02 [mm]. When the reflecting member 126 is attached to the tip of the rising part 125*b* as in this embodiment, the distance d needs to be set so that the reflecting member 126 does not touch the fixing belt 121.

By disposing the tip of the rising part 125*b* of the stay 125 as close to the inner peripheral surface of the fixing belt 121 as possible, the rising part 125*b* can be disposed long in the abutting direction of the pressing roller 122. Thus, even in the configuration including the fixing belt 121 with small diameter, the mechanical strength of the stay 125 can be improved.

In the fixing device 100 in the configuration example illustrated in FIG. 2 to FIG. 4, the nip forming member 124 can guide the fixing belt 121 entering the nip portion N, so that the fixing belt 121 can enter the nip portion N stably and smoothly while the behavior of the belt is suppressed before the fixing belt 121 enters the nip portion N. By guiding the fixing belt 121 with the nip forming member 124, the fixing belt 121 can be rotated stably and smoothly even in a configuration where the guide member is not provided at an area other than the nip forming member 124 except the both ends of the fixing belt 121. Thus, since the friction can be suppressed by reducing the load on the fixing belt 121 during the rotation, the damage or disconnection of the fixing belt 121 can be prevented and the reliability as the device is improved. Also in the configuration in which the fixing belt 121 is thinned for reducing the heat capacity as in the fixing device 100 in each of the above configuration examples in particular, the damage or disconnection of the fixing belt 121 can be prevented.

In the fixing device 100 in the configuration example illustrated in FIG. 2 to FIG. 4, the fixing belt 121 can be guided by the nip forming member 124; therefore, the configuration can be simplified and reduced in size and cost. This can reduce the heat capacity of the fixing device 100 further and shorten the warm-up time; therefore, the energy-saving property can be improved and the first printing time can be shortened.

Moreover, when the nip forming member 124 also functions as a guide, an additional guide is not necessary, in which case nothing is necessary between the inner peripheral surface of the fixing belt 121 and the upstream side part and the downstream side part of the stay 125 in the paper conveying direction (so that they face each other directly). This allows the stay 125 to be disposed as large as possible in the limited space in the fixing belt 121 because the stay 125 can be disposed close to the inner peripheral surface of the fixing belt 121 on the upstream side and the downstream side of the paper conveying direction. As a result, even in the configuration in which the fixing belt 121 is reduced in diameter for the reduction in heat capacity like in the fixing device 100 in the above configuration example, the strength of the stay 125 can be secured and the bending of the nip forming member 124 by the pressing roller 122 can be prevented and the fixing property can be improved.

Moreover in the fixing device 100 in the configuration examples illustrated in FIG. 2 to FIG. 4, by disposing the nip forming member 124 inwardly apart from the fixing belt 121 in a state that the pressing roller 122 does not abut on the fixing belt 121, the fixing belt 121 can be set in the state that the fixing belt 121 is not pressed strongly against the nip forming member 124 on each of the upstream side and the downstream side of the nip portion N in the paper conveying direction. This can suppress the slide load or friction caused by the contact between the fixing belt 121 and the nip forming member 124. Moreover, by weakening the force that brings the fixing belt 121 in contact with the nip forming member 124, the optimization of the entrance path of the fixing belt 121 into the nip portion N can be achieved.

In the case of the device in which the rotation speed of the pressing roller 122 is high and the number of sheets of paper fed in a minute is large, a thermistor (pressing thermistor) for detecting the temperature of the pressing roller 122 may be provided. In a high-speed machine with the rotation speed of the pressing roller 122 set high, the shortage of the quantity of heat of the fixing belt 121 easily occurs. Therefore, in the warm-up operation, the surface temperature of the pressing roller 122 is detected by the pressing thermistor, and when the surface temperature of the pressing roller 122 and the surface temperature of the fixing belt 121 have reached their predetermined temperatures, the fixing operation is started. A thermistor detecting the temperature of the pressing roller 122 may be added in the paper non-feeding region of the pressing roller 122. For example, when sheets of paper with a small size are continuously fed, there is a risk that the end of the pressing roller 122 or the fixing belt 121 has abnormally high temperature to cause malfunction of the device. Therefore, to avoid the malfunction, the thermistor disposed in this paper non-feeding region detects the temperature and when the temperature has reached the predetermined temperature or more, the device is controlled to stop.

Figure 5:
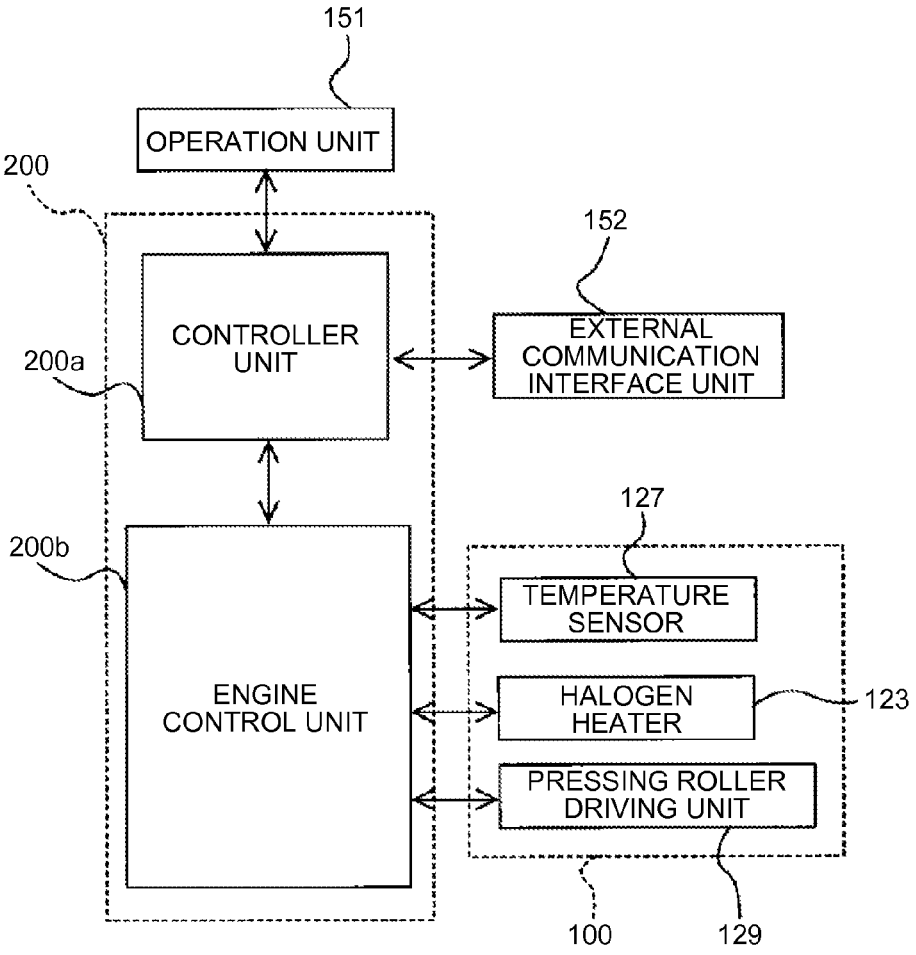
FIG. 5 is a block diagram illustrating one example of a main part of a control system controlling the fixing device.

FIG. 5 is a block diagram illustrating one example of a main part of a control system controlling the fixing device 100 according to this embodiment.

A control unit 200 as a controller includes a controller unit 200*a* and an engine control unit 200*b*.

The controller unit 200*a* includes a CPU, a ROM, a RAM, and the like, and is connected to the engine control unit 200*b*, the operation unit 151, an external communication interface unit 152, and the like. The controller unit 200*a* executes a preinstalled control program to control over the entire image forming apparatus 1000 or over the input from the external communication interface unit 152 or the operation unit 151, for example. The controller unit 200*a* accepts the input of an instruction from a user, which has been input through the operation unit 151, and performs various types of processing in accordance with the input of the instruction, for example. The controller unit 200*a* receives image data or an instruction of a print job (image forming job) from an external host computer device or the like via the external communication interface unit 152, controls the engine control unit 200*b*, and controls the image forming operation for forming and outputting a color image or a monochromatic image onto the paper. The controller unit 200*a* also has a function as a measuring unit for measuring the time for idling the fixing belt 121 and the pressing roller 122 for equalizing the temperature more quickly by decreasing the temperature of the high-temperature part of the fixing belt 121.

The engine control unit 200*b* includes a CPU, a ROM, a RAM, and the like and by executing the preinstalled control program, performs the control over a printer engine (the image forming units, the optical writing device 8, the fixing device 100, and the like) for performing the image formation operation on the basis of the instruction from the controller unit 200*a*. For example, in the image forming operation mode, the engine control unit 200*b* controls the power supply to the halogen heater 123 or controls a pressing roller driving unit 129 for rotating and driving the pressing roller 122 so that the temperature of the fixing belt 121 detected by the temperature sensor 127 becomes a predetermined target temperature.

The image forming apparatus 1000 according to this embodiment has three modes: the image forming operation mode; the stand-by mode; and the sleep mode. The image forming operation mode refers to the state in which the image forming apparatus 1000 performs the image formation operation. The stand-by mode refers to the state in which the image forming apparatus 1000 waits for the execution instruction of the image formation operation. The sleep mode refers to the state in which the power consumption is lower than that in the stand-by mode. In the image forming operation mode, for example, in the fixing device 100, the warm-up operation for increasing the temperature of the fixing belt 121 to a predetermined fixing target temperature (for example 158 to 170° C.) is performed and then the fixing operation is performed. In the stand-by mode, the temperature of the fixing belt 121 in the fixing device 100 is maintained at a predetermined temperature (for example 90° C.) lower than the fixing target temperature in the image forming operation mode. In the sleep mode, the power supply to the printer engine or the engine control unit 200*b* in the fixing device 100 or the like is stopped, so that the power supply to the halogen heater 123 and the rotation and driving of the pressing roller 122 are impossible.

Next, the control over the fixing temperature of the fixing device in the image forming apparatus with the above configuration will be described.

Figure 6:
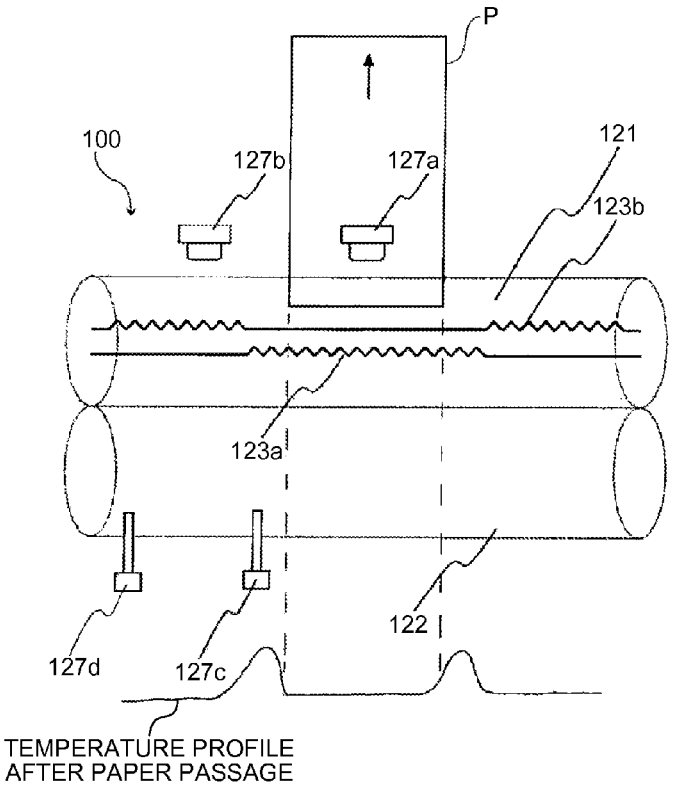

FIG. 6 is a schematic configuration explanatory diagram illustrating the position of a thermopile or the like as a temperature detecting unit for measuring the temperature of the pressing roller 122 or the fixing belt 121 of the fixing device 100, and also illustrates in the lower part of the drawing, the temperature profile after the passage of the paper when the paper P with a B5 size is fed in portrait orientation.

As illustrated in FIG. 6, a center thermopile 127*a* is disposed at a position facing the center in a width direction orthogonal to the rotation direction of the fixing belt 121, and an end thermopile 127*b* is disposed at a position facing the end in the width direction. Moreover, a center-deviated thermistor 127*c* is disposed at an intermediate position between the center and the end in the width direction orthogonal to the rotation direction of the pressing roller 122 and at the position facing the center-deviated position, and an end thermistor 127*d* is disposed at a position facing the end in the width direction. In the example of FIG. 6, the halogen heater 123 includes two halogen heaters of a center-heating halogen heater 123*a* and an end-heating halogen heater 123*b*.

The center-heating halogen heater 123*a* of the fixing device 100 illustrated in FIG. 6 heats the fixing belt 121 in the axial direction thereof over a wider range than the length (width) of paper P in the width direction orthogonal to the conveying direction of the paper P for surely heating the paper P. Therefore, as indicated by the temperature profile in FIG. 6, in regions in which the fixing belt 121 is not in contact with the paper P and which corresponds to the outside of both end of the paper P in the width direction, high-temperature portions are generated in which the temperature locally rises because the cooling due to the paper P is not performed. If the next job is performed in a state that the temperature of the high-temperature portions of this fixing belt 121 is not dropped, for example, in the case where the sheets of paper each with an A4 size in portrait larger than the B5 size in portrait are fed continuously, there may be formed an abnormal image such as a hot offset image or gloss unevenness in an area which is in contact with the high-temperature portions.

To prevent this abnormal image, after the execution of the continuous image forming jobs, heat-equalizing rotation is performed for equalizing the temperature of the fixing belt 121 by reducing the temperature of the high-temperature portions in such a manner that only the fixing belt 121 and the pressing roller 122 are idled with the paper P not conveyed. However, if the constant heat-equalizing rotation is always performed after the execution of the continuous image forming jobs, constant waiting time is generated, which causes the completion time of the next image forming job to be late by the amount of the waiting time. This results in that the total printing time becomes longer.

In view of this, the present inventors have conducted concerted studies and found that it is effective to appropriately select the termination condition of the heat-equalizing rotation depending on the content of the next image forming job as the image formation related information related to the next image formation to be performed after the heat-equalizing rotation. In other words, it has been found that the occurrence of the fixing failure due to the unequal distribution of the temperature of the fixing belt 121 in the width direction can be prevented and the image forming time required for forming the image on the paper P can be shortened by appropriately selecting the termination condition such as the temperature of the fixing belt 121 or the time of the heat-equalizing rotation on the basis of the image information such as whether the image to be formed according to the next image forming job is the full-color image or the monochromatic image or of the image formation related information such as the size magnitude correlation of the paper P fixed and conveyed according to the previous job and the next job.

Figure 7:
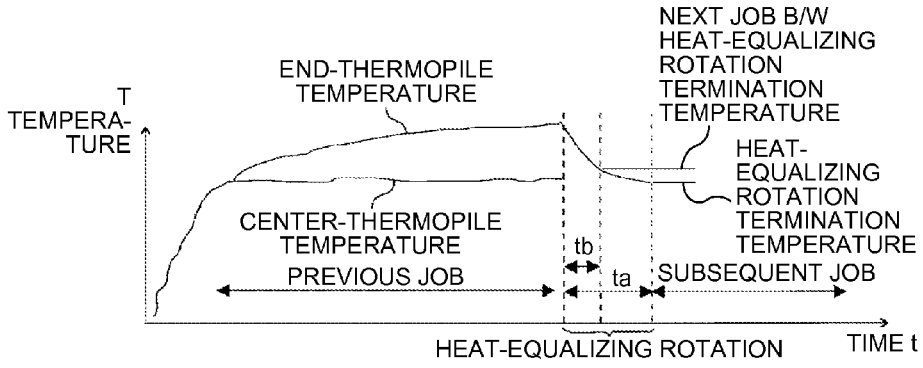
FIG. 7 is a graph expressing an example of temperature change at a center and an end of the fixing belt in the axial direction.

FIG. 7 is a graph representing one example of temperature change at the center and the end of the surface of the fixing belt 121 in the axial direction, with which description is made of the control for equalization by performing heat-equalizing rotation between the previous job and the next job to decrease the temperature at the end.

Figure 8:
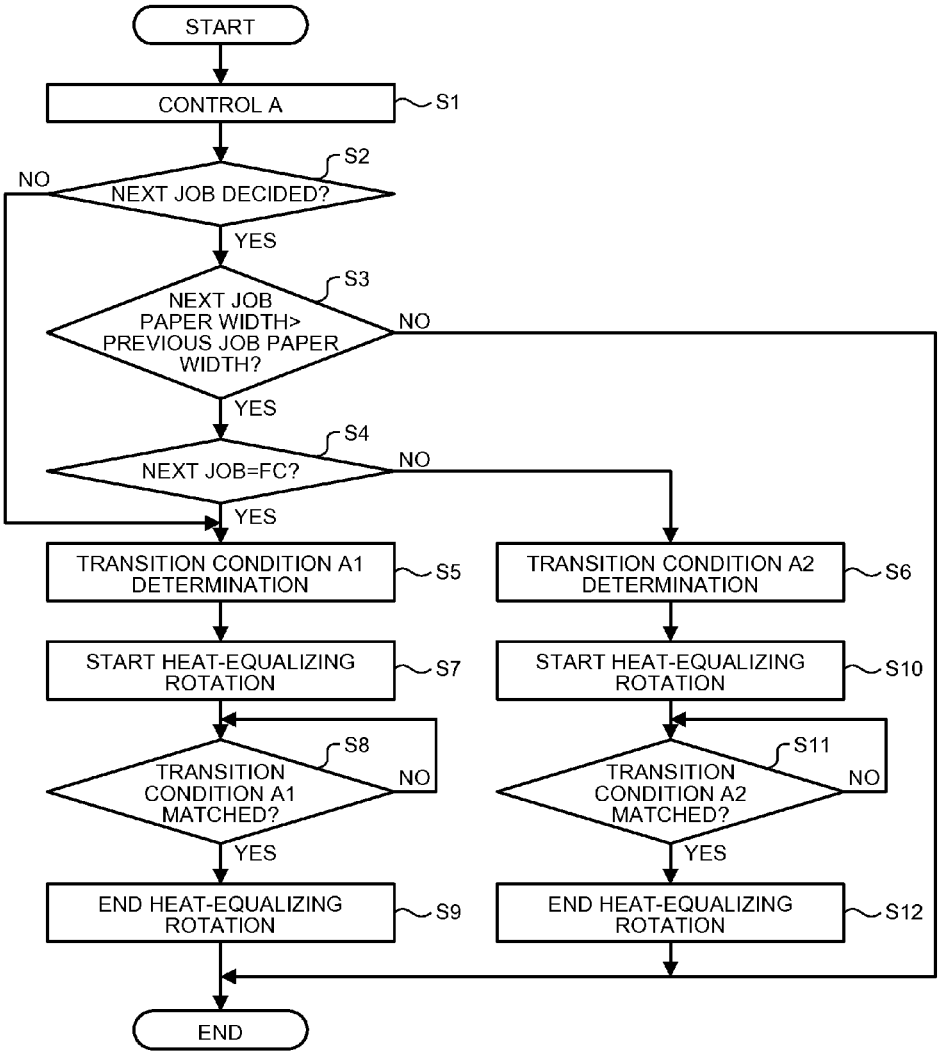
FIG. 8 is a flow chart for describing the control of heat-equalizing rotation.

Moreover, FIG. 8 is a flow chart for describing the control of the start and the end of the execution of the heat-equalizing rotation.

As indicated in FIG. 7, as a result of performing the continuous paper feeding in the previous job, the temperature at the end corresponding to the outside region of the end of the paper P in the width direction (see the graph of the end thermopile temperature) gets higher than the temperature of the center of the fixing belt 121 in the axial direction (see the graph of the center thermopile temperature). Conventionally, to prevent the occurrence of the abnormal image due to the high-temperature portion at the end, a waiting time "ta" during which the heat-equalizing rotation is performed is secured so that the temperature at the end is decreased down to approximately the same temperature as the temperature at the center. In the case where the next job is a monochromatic image, the abnormal image is not formed even though the temperature at the end is slightly higher than the temperature at the center; therefore, the waiting time during which the heat-equalizing rotation is performed can be shortened to "tb". Therefore, the waiting time can be shortened, and the next job can be started early; therefore, the total printing time can be shortened. Note that the "job" used in this explanation refers to, among the various types of the continuous image forming job, the continuous forming image job onto the same size sheets, i.e., a continuous image forming operation for continuously forming images on the sheets of paper having the same size. Additionally, this continuous forming image job onto the same size sheets includes a case in which there is a few interruption of the continuous image forming job onto the different size sheets during the continuous forming image job onto the same size sheets. In that case, depending on the ratio, the continuous image forming job onto the different size sheets may be regarded as the continuous image forming job onto the same size sheets.

The control of the heat-equalizing rotation will be specifically described using the flow chart of FIG. 8.

Upon the start of the image forming operation, the control of the heat-equalizing rotation (hereinafter, "control A") is performed (Step S1). During the control A, state transition into another control is prohibited. Upon the completion of the execution of the previous job (here, the first job), whether the next job has been decided or not is determined (Step S2). If the next job has been decided (Yes in Step S2), the paper width of the next job and the paper width of the previous job are compared (Step S3). Meanwhile, if the next job has not been decided (No in Step S2), the heat-equalizing rotation for the full-color image is performed in view of the safety. Then, when the paper width of the next job is larger than that of the previous job (Yes in Step S3), whether the next job is the full-color image (FC) printing or not is determined (Step S4); when the paper width of the next job is smaller than or equal to that of the previous job (No in Step S3), the control A terminates because no abnormal image is formed. In this case, the termination of the control A does not lead to the heat-equalizing rotation; therefore, there is no waiting time for the heat-equalizing rotation and thus, the printing time for the next job is shortened.

In the case where the next job is the full-color image (FC) mode in Step S4 (Yes in Step S4), determination of transition condition A1 is performed (Step S5); in the case where the next job is not the full-color image (monochromatic (B/W)) mode (No in Step S4), determination of transition condition A2 is performed (Step S6).

Here, the determination of transition condition A1 in Step S5 is the process for determining the termination condition of the heat-equalizing rotation on the basis of the condition of the previous job from the condition determination table in Table 1 below, by which "when next job is unknown or FC mode" is selected.

In the condition determination table in Table 1, a plurality of termination conditions are set for each paper width of the previous job. For example, when the paper width L of the previous job satisfies B4T<L≤DLT (257 [mm]<L≤279.4 [mm]) and the paper feeding time t1 of the previous job satisfies t1<set time 101, the termination condition of the heat-equalizing rotation is set as follows: detection temperature (written as "sensor temperature" in Table 1, and this similarly applies to the following description) of the thermistor 127*d*≤120[° C.]; and control A passage time t2=0. When the paper width L of the previous job is the same and the paper feeding time t1 of the previous job satisfies set time 101≤t1, the termination condition of the heat-equalizing rotation is set as follows: detection temperature of the thermistor 127*d*≤120[° C.]; and set time 102≤control A passage time t2.

Similarly, the determination of transition condition A2 of Step S6 is the process for determining the termination condition of the heat-equalizing rotation on the basis of the condition of the previous job from the condition determination table in Table 1, by which "when next job is B/W mode" is selected. For example, when the paper width L of the previous job satisfies B4T<L≤DLT (257 [mm]<L≤279.4 [mm]) and the paper feeding time t1 of the previous job satisfies t1<set time 101, the termination condition of the heat-equalizing rotation is set as follows: detection temperature as the sensor temperature of the thermistor 127*d*≤125[° C.]; and control A passage time t2=0. When the paper width L of the previous job is the same and the paper feeding time t1 of the previous job satisfies set time 101≤t1, the termination condition of the heat-equalizing rotation is set as follows: detection temperature of the thermistor 127*d*≤125[° C.]; and set time 102 control A passage time t2.

In this manner, in the example of the condition determination table in Table 1, the sensor temperature is set differently between when the next job is unknown or FC mode and when the next job is B/W mode, for each paper width L of the previous job. The monochromatic image (B/W) has a wider allowance for the abnormal image such as hot offset or gloss unevenness than the full-color image (FC); therefore, the temperature can be set higher for the monochromatic image in the termination condition for the heat-equalizing rotation. Thus, in the case where the next job is the monochromatic image printing (B/W mode), the waiting time of the heat-equalizing rotation can be shortened as compared with the full-color (FC) image printing; therefore, the printing time of the next job can be shortened.

TABLE 1

| Condition of previous job | | Termination conditions of Control A | | | |
|---|---|---|---|---|---|
| | | When next job is unknown or FC mode (transition condition A1) | | When next job is B/W mode (transition condition A2) | |
| Paper width L of previous job | Paper feeding time t1 of previous job | Sensor temperature | Control A passage time t2 | Sensor temperature | Control A passage time t2 |
| B4T < L ≤ DLT (257 mm < L ≤ 279.4 mm) | t1 < set time 101<br>set time 101 ≤ t1 | 120° C. or less (thermistor 127d) | 0<br>set time 102 ≤ t2 | 125° C. or less (thermistor 127d) | 0<br>set time 102 ≤ t2 |
| LTT < L ≤ B4T (215.9 mm < L ≤ 257 mm) | t1 < set time 103<br>set time 103 ≤ t1 | 150° C. or less (thermistor 127d) | 0<br>set time 104 ≤ t2 | 155° C. or less (thermistor 127d) | 0<br>set time 104 ≤ t2 |
| B5T < L ≤ LTT (182 mm < L ≤ 215.9 mm) | t1 < set time 105<br>set time 105 ≤ t1 | 200° C. or less (thermistor 127b) | 0<br>set time 106 ≤ t2 | 210° C. or less (thermistor 127b) | 0<br>set time 106 ≤ t2 |
| A5T < L ≤ B5T (148.5 mm < L ≤ 182 mm) | t1 < set time 107<br>set time 107 ≤ t1 | less than 150° C. (thermistor 127c) | 0<br>set time 108 ≤ t2 | less than 155° C. (thermistor 127c) | 0<br>set time 108 ≤ t2 |
| B6T < L ≤ A5T (128.5 mm < L ≤ 148.5 mm) | t1 < set time 109<br>set time 109 ≤ t1 | less than 150° C. (thermistor 127c) | 0<br>set time 110 ≤ t2 | less than 155° C. (thermistor 127c) | 0<br>set time 110 ≤ t2 |
| A6T < L ≤ B6T (105 mm < L ≤ 128.5 mm) | t1 < set time 111<br>set time 111 ≤ t1 | less than 140° C. (thermistor 127c) | 0<br>set time 112 ≤ t2 | less than 145° C. (thermistor 127c) | 0<br>set time 112 ≤ t2 |

In Table 1 above, for example B4T represents the paper width when a B4-sized sheet of paper is fed in portrait orientation, DL represents an 11×7-inch-sized sheet of paper, and LT represents an 8½×11-inch-sized sheet of paper, which is often used abroad. Moreover, the temperature of the paper non-feeding part where the paper P does not pass is gradient in the axial direction; therefore, the reference value relative to the sensor temperature (detected temperature) is set in accordance with the paper width as appropriate (for example, 120[° C.], 125[° C.], 140[° C.], 145[° C.], 150[° C.], 155[° C.], 200[° C.], and 210[° C.] in Table 1). The set time 101, 103, 105, 107, 109, and 111 in Table 1 represent the reference time set in advance relative to the previous job paper feeding time t1. The set time 102, 104, 106, 108, 110, and 112 in Table 1 represent the reference time set in advance relative to the control A passage time t2.

Then, in the case where the next job is the full-color image, the determination of transition condition A1 is performed in Step S5, and the heat-equalizing rotation of the fixing belt 121 is started (Step S7). The heat-equalizing rotation is continued until the condition of the transition condition A1 is satisfied (Step S8). For example, when the paper width L of the previous job satisfies B4T<L≤DLT (257 [mm]<L≤279.4 [mm]) and the paper feeding time t1 of the previous job satisfies the set time 101≤t1, the heat-equalizing rotation ends upon the satisfaction of the condition of the detected temperature of the thermistor 127*d*≤120[° C.] or the set time 102≤control A passage time t2 (Step S9).

Meanwhile, when the next job is not the full-color image, the determination of transition condition A2 is performed in Step S6, and the heat-equalizing rotation of the fixing belt 121 is started (Step S10). The heat-equalizing rotation is continued until the condition of the transition condition A2 is satisfied (Step S11). For example, when the paper width L of the previous job satisfies B4T<L≤DLT (257 [mm]<L≤279.4 [mm]) and the paper feeding time t1 of the previous job satisfies the set time 101≤t1, the heat-equalizing rotation ends upon the satisfaction of one of or both the condition of the detected temperature of the thermistor 127*d*≤125[° C.] and the condition of the set time 102≤control A passage time t2 (Step S12).

As described using the flow chart of FIG. 8, when the time of the heat-equalizing rotation between the previous job and the next job is changed depending on the information of the next job, the printing time can be shortened as compared with the case where the heat-equalizing rotation is performed constantly regardless of the information of the next job. That is, when the paper width of the next job is less than or equal to that of the previous job, there is no waiting time because the heat-equalizing rotation is not performed; thus, the printing time of the next job is shortened. In the case where the next job is not the full-color image (monochromatic image), the sensor temperature is set higher than in the case of the full-color image, thereby shortening the time of the heat-equalizing rotation.

Although not indicated in Table 1, the hot offset or gloss unevenness easily occurs in a half-tone image; therefore, the termination condition of the heat-equalizing rotation may be set a little higher as long as the image is letter script. As for the resolution of the image, the temperature for a low-resolution image may be set higher than that for a high-resolution image.

The detection may be performed not based on the temperature but based on the experimentally obtained numeral value and the number of sheets of paper and time of the previous job to set the heat-equalizing rotation time.

The control for shortening the time of the heat-equalizing rotation can be applied to not just the heat-equalizing rotation performed between the continuous different jobs but also to the heat-equalizing rotation performed in the case where the size is switched to the larger paper width size in one job.

Moreover, during the heat-equalizing rotation, turning off the halogen heater 123 is more effective for shortening the heat-equalizing rotation time because the temperature of the high-temperature portion of the fixing belt 121 is dropped more quickly.

The above described is an example, and the present invention provides the unique effect for every aspect described below.

Aspect A

The image forming apparatus 1000 includes the fixing device 100, and the fixing device 100 includes: the fixing member such as the rotatable fixing belt 121 having an endlessly moving surface; the heat source such as the halogen heater 123 that heats the fixing member; the pressing member such as the rotatable pressing roller 122 that is pressed and comes in pressure-contact with the fixing member so as to for a nip portion therebetween; and the rotary drive unit such as the pressing roller driving unit 129 that rotationally drives the fixing member or the pressing member. Further provided is the control unit such as the control unit 200 configured to control the rotary drive unit to perform heat-equalizing rotation of the fixing member and the pressing member for equalizing distribution of temperature of the surface of the fixing member in a width direction orthogonal to a recording medium conveying direction at the nip portion N, after a recording medium such as paper P having a size less than or equal to a predetermined size in the width direction passes the nip portion N and before a recording medium having a size greater than the predetermined size in the width direction passes the nip portion N. The control unit is further configured to select a termination condition of the heat-equalizing rotation from among a plurality of different kinds of termination conditions based on image formation related information related to next image formation performed after the heat-equalizing rotation.

According to this aspect, as described in the embodiment, the heat-equalizing rotation of the fixing member and the pressing member for equalizing the distribution of the temperature of the surface of the fixing member in the width direction is performed after the recording medium having a size less than or equal to a predetermined size in the width direction orthogonal to the recording medium conveying direction passes the nip portion N and before the recording medium having a size greater than the predetermined size in the width direction passes the nip portion N. This heat-equalizing rotation can prevent the occurrence of fixing failure that is caused by the inhomogeneous distribution of the temperature of the fixing member in the width direction. As the termination condition of the heat-equalizing rotation, any one of the plurality of different kinds of termination conditions is selected based on the image formation related information related to the next image formation performed after the heat-equalizing rotation; on the basis of the selected termination condition, the heat-equalizing rotation is terminated. Since the appropriate termination condition for the heat-equalizing rotation is thus selected in accordance with the image formation related information, the image forming time required for forming an image on the recording medium can be shortened as compared with the case in which the heat-equalizing rotation is completed under the same termination condition regardless of the image formation related information.

Aspect B

In Aspect A described above, the image forming apparatus further includes a temperature detecting unit such as a temperature sensor that detects temperature of at least one of members constituting the fixing device 100. The termination conditions include a condition that a detection result of the temperature detecting unit matched with a predetermined temperature set in advance. According to this aspect, as described in the embodiment, the termination condition of the heat-equalizing rotation involving the rotation of the fixing member is selected based on the detection result of the temperature of at least one of the members constituting the fixing device 100 related to the temperature of the surface of the fixing member forming the nip portion through which the recording medium passes; therefore, the heat-equalizing rotation is performed neither too much nor too little in accordance with the temperature of the surface of the fixing member, thereby increasing the accuracy of the control for equalizing the distribution of the temperature of the surface of the fixing member in the width direction.

Aspect C

In Aspect B described above, the temperature detecting unit such as the temperature sensor 127 detects the temperature of the fixing member such as the fixing belt 121. According to this aspect, as described in the embodiment, the termination condition of the heat-equalizing rotation involving the rotation of the fixing member is selected based on the detection result of the temperature of the fixing member forming the nip portion through which the recording medium passes; therefore, the accuracy of the control for equalizing the distribution of the temperature on the surface of the fixing member in the width direction can be further increased.

Aspect D

In any of Aspects A to C described above, the plural kinds of termination conditions include the condition that a predetermined time has passed from start of the heat-equalizing rotation. According to this aspect, as described in the embodiment, the termination condition of the heat-equalizing rotation involving the rotation of the fixing member is selected based on the predetermined passage time obtained in advance from experiments or the like; therefore, the accuracy of the control for equalizing the distribution of the temperature of the surface of the fixing member in the width direction can be further increased.

Aspect E

In any of Aspects A to D described above, the image formation related information related to the next image formation performed after the heat-equalizing rotation is image information of an image formed after the heat-equalizing rotation. According to this aspect, as described in the embodiment, the termination condition of the heat-equalizing rotation involving the rotation of the fixing member is selected based on the image information of the image formed after the heat-equalizing rotation; therefore, the accuracy of the control for equalizing the distribution of the temperature of the surface of the fixing member in the width direction can be further increased. For example, in the case where the image formed after the heat-equalizing rotation is a monochromatic image, the fixing failure is difficult to occur even though the accuracy of the control for equalizing the distribution of the temperature of the surface of the fixing member in the width direction is slightly worse than that for a full-color image; therefore, the temperature can be set higher or the time can be set shorter in the termination condition of the heat-equalizing rotation. In this manner, the occurrence of the fixing failure can be prevented more surely in accordance with the image formed after the heat-equalizing rotation, and the image forming time required for forming the image on the recording medium can be shortened more surely.

Aspect F

In any of Aspects A to D described above, the image formation related information related to the next image formation performed after the heat-equalizing rotation is the size information in the width direction of a recording medium on which an image is formed after the heat-equalizing rotation. According to this aspect, as described in the embodiment, the termination condition of the heat-equalizing rotation involving the rotation of the fixing member is selected based on the size information of the recording medium in the width direction on which the image is formed after the heat-equalizing rotation; therefore, the accuracy of the control for equalizing the distribution of the temperature on the surface of the fixing member in the width direction can be further increased. For example, in the case where the size of the recording medium in the width direction on which the image is formed after the heat-equalizing rotation is less than or equal to the size of the recording medium in the width direction which has passed the nip portion N before the heat-equalizing rotation, the fixing failure due to the unequal distribution of the temperature in the width direction of the fixing member does not occur; therefore, the heat-equalizing rotation is not necessary, in which case the image forming time required for forming the image on the recording medium can be shortened more surely.

Aspect G

In any of Aspects A to F described above, when the image formation related information related to the next image formation performed after the heat-equalizing rotation cannot be acquired, the control unit selects and uses, from among the plural kinds of termination conditions, a termination condition under which the longest heat-equalizing rotation is performed. According to this aspect, as described with reference to the above embodiment, when the image formation related information related to the next image formation performed after the heat-equalizing rotation cannot be acquired, i.e., when the next image job is unknown, the control unit selects and uses, from among the plural kinds of termination conditions, the termination condition (termination condition under which the longest heat-equalizing rotation (in the embodiment, the heat-equalizing rotation for the full-color image) is performed; therefore, the sufficient heat-equalizing rotation is performed in view of the safety. Thus, the occurrence of the fixing failure due to the inhomogeneous distribution of the temperature of the fixing member in the width direction can be prevented more surely.

Aspect H

In any of Aspects A to G described above, in the case of performing a plurality of image forming jobs continuously in which recording media for having images formed thereon are different in size in the width direction, the control unit performs the heat-equalizing rotation after the recording medium at a completion time of the image forming job for forming the image on the recording medium with a size less than or equal to a predetermined size passes the nip portion N and before the recording medium at a start time of the next image forming job for forming the image on the recording medium with a size greater than the predetermined size passes the nip portion, and the image formation related information related to the next image formation performed after the heat-equalizing rotation is information of the next image forming job. According to this aspect, as described in the embodiment, in the case of performing the plurality of image forming jobs continuously in which recording media for having images formed thereon are different in size in the width direction, control is performed so as to select the termination condition of the heat-equalizing rotation involving the rotation of the fixing member based on the information of the next image forming job; therefore, the accuracy of control for equalizing the distribution of the temperature on the surface of the fixing material in the width direction can be increased.

Aspect I

In any of Aspects A to H described above, the pressing member is configured to be rotationally driven, the fixing member has a hollow internal space capable of housing therein the heat source such as the halogen heater 123, and is a belt member or a film member capable of being driven in accordance with the pressing member which is rotationally driven, and the fixing device 100 further includes the nip forming member 124 provided in the internal space of the fixing member so as to form the nip portion N under pressure applied from the pressing member via the fixing member.

According to this aspect, as described in the embodiment, the predetermined nip portion can be formed between the fixing member and the pressing member by making the nip forming member provided in the internal space of the fixing member receive the pressure applied from the pressing member via the fixing member. The fixing member is heated by the heat source disposed in the hollow internal space and is driven following the pressing member which is rotationally driven, so that the temperature of the nip portion moving by the contact between the fixing member and the pressing member can be maintained at predetermined temperature necessary for the fixture.

Moreover, since the fixing member formed of the belt member heated by the heat source has smaller heat capacity than the fixing member formed of a roller member or the like, the energy required for heating the fixing member can be drastically reduced, the energy-saving property can be improved, and the warm-up time and first printing time can be shortened. Moreover, even in the case of the use of the fixing member which easily has a high-temperature portion in which the temperature is locally high when a small recording medium with a small size in the width direction passes through the nip portion N due to the reduction in heat capacity, the occurrence of the fixing failure due to unequal temperature distribution of the fixing member in the width direction can be prevented and the image forming time required for forming an image on the recording medium can be shortened.

Aspect J

In any of Aspects A to I described above, the heat source such as the halogen heater 123 heats directly the fixing member such as the fixing belt 121 through radiation heat. According to this aspect, as described with reference to the above embodiment, the provision of a metal thermal conductor for conducting heat between the heat source and the fixing member is not necessary; therefore, the energy-saving property can be improved and the warm-up time and first printing time can be shortened further.

The embodiment of the present invention has been described so far; needless to say, the present invention is not limited to the embodiment above and various modifications can be made without departing from the content of the present invention. Further, the fixing device according to the present invention can be mounted on, not just the color laser printer illustrated in FIG. 1, but also a monochromatic image forming apparatus, another printer, a copier, a facsimile, or an MFP including any of these, or the like.

According to the present invention, in the case where an image is formed on a recording medium with a size in a width direction thereof which is orthogonal to a recording medium conveying direction at a nip portion of the fixing device, less than or equal to a predetermined size, and then, an image is formed on a recording medium with the size in the width direction larger than the predetermined size, the occurrence of fixing failure due to the inhomogeneous distribution of temperature of the fixing member in the width direction can be prevented and the image forming time required for forming the images on these recording media can be shortened.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus including a fixing device, the fixing device comprising:

a rotatable fixing member having an endlessly moving surface;

a heat source that heats the fixing member;

a rotatable pressing member that is pressed and comes in pressure-contact with the fixing member so as to form a nip portion therebetween;

a rotary drive unit that rotationally drives the fixing member or the pressing member;

a control unit configured to control the rotary drive unit to perform heat-equalizing rotation of the fixing member and the pressing member for equalizing distribution of temperature of the surface of the fixing member in a width direction orthogonal to a recording medium conveying direction at the nip portion, at a time after a recording medium having a size less than or equal to a predetermined size in the width direction passes the nip portion and before a recording medium having a size greater than the predetermined size in the width direction passes the nip portion, wherein the control unit is configured to select a termination condition of the heat-equalizing rotation from among a plurality of different kinds of termination conditions based on image formation related information related to next image formation to be performed after a next heat-equalizing rotation; and a temperature detecting unit that detects temperature of at least one of members constituting the fixing device, the temperature detecting unit being disposed at a position facing an end in the width direction of the fixing member, wherein the termination conditions include a condition that a detection result of the temperature detecting unit corresponds to a predetermined temperature set in advance, wherein the image formation related information related to the next image formation performed after the heat-equalizing rotation is image information of an image to be formed after the heat-equalizing rotation, the image formation of the image indicates that a job is either a color image or a monochromatic image, and the predetermined temperature for the termination conditions of the heat-equalizing rotation is set differently between when the job is the color image and when the job is the monochromatic image, the predetermined temperature being set higher for the monochromatic image than for the color image.

2. The image forming apparatus according to claim 1, wherein the temperature detecting unit detects a temperature of the fixing member.

3. The image forming apparatus according to claim 1, wherein the termination conditions include a condition that a predetermined time has passed from start of the heat-equalizing rotation.

4. The image forming apparatus according to claim 1, wherein the image formation related information related to the next image formation performed after the heat-equalizing rotation is size information of a recording medium in the width direction on which an image is formed after the heat-equalizing rotation.

5. The image forming apparatus according to claim 1, wherein, when the image formation related information related to the next image formation performed after the heat-equalizing rotation cannot be acquired, the control unit selects and uses, from among the termination conditions, a termination condition under which the longest heat-equalizing rotation is performed.

6. The image forming apparatus according to claim 1, wherein:

the control unit, in the case of performing a plurality of image forming jobs continuously in which recording media for having images formed thereon are different in size in the width direction, performs the heat-equalizing rotation after the recording medium at a termination time of the image forming job for forming the image on the recording medium with a size less than or equal to a predetermined size passes the nip portion and before the recording medium at a start time of the next image forming job for forming the image on the recording medium with a size greater than the predetermined size passes the nip portion; and the image formation related information related to the next image formation performed after the heat-equalizing rotation is information of the next image forming job.

7. The image forming apparatus according to claim 1, wherein:

the pressing member is configured to be rotationally driven;

the fixing member has a hollow internal space capable of housing the halogen heater therein, and is a belt member or a film member capable of being driven in accordance with the pressing member which is rotationally driven; and the fixing device further includes a nip forming member provided in the internal space of the fixing member to form the nip portion under pressure applied from the pressing member via the fixing member.

8. The image forming apparatus according to claim 1, wherein the heat source directly heats the fixing member through radiation heat.

9. The image forming apparatus according to claim 1, wherein the image formation related information related to the next image formation to be performed after the heat-equalizing rotation includes recording medium size and color scheme of the next image formation.

10. The image forming apparatus according to claim 1, wherein the plurality of kinds of termination conditions are set in accordance with a size of a recording medium of a previous job.

* * * * *